United States Patent [19]

Walker

[11] Patent Number: 4,930,981

[45] Date of Patent: Jun. 5, 1990

[54] LOW NOISE IMPELLER

[75] Inventor: Dean M. Walker, Loveland, Colo.

[73] Assignee: Walker Manufacturing Company, Fort Collins, Colo.

[21] Appl. No.: 395,961

[22] Filed: Aug. 18, 1989

[51] Int. Cl.[5] ..... F04D 29/66

[52] U.S. Cl. ..... 415/119; 416/186 R; 416/228

[58] Field of Search ..... 415/119, 206; 416/223 R, 223 B, 179, 182, 186 R, 228

[56] References Cited

U.S. PATENT DOCUMENTS

| | | | |
|---|---|---|---|
| 351,457 | 4/1907 | Verner | 416/186 R |
| 869,868 | 10/1907 | Spencer . | |
| 1,515,268 | 11/1924 | Morrow | 416/228 |
| 3,802,171 | 4/1974 | Cousino | 56/13.4 |
| 3,947,148 | 3/1976 | Holt | 415/119 |
| 4,012,172 | 3/1977 | Schwaar et al. | 416/228 |
| 4,028,005 | 6/1977 | Eck | 416/186 R |
| 4,063,852 | 12/1977 | O'Connor | 416/228 |
| 4,097,192 | 6/1978 | Kulina | 416/228 |
| 4,121,405 | 10/1978 | Wolf | 56/12.9 |
| 4,131,387 | 12/1978 | Kazin et al. | 415/119 |
| 4,152,094 | 5/1979 | Honda et al. | 415/119 |
| 4,170,098 | 10/1979 | Moreno et al. | 56/13.9 |
| 4,193,249 | 3/1980 | Tackett | 56/11.9 |
| 4,213,289 | 7/1980 | Kamppinen | 56/295 |
| 4,214,426 | 7/1980 | Lindblad | 56/295 |
| 4,253,800 | 3/1981 | Segawa et al. | 416/203 |
| 4,310,998 | 1/1982 | Cuba | 56/202 |
| 4,345,416 | 8/1982 | Cameron | 56/13.3 |
| 4,370,097 | 1/1983 | Hanson et al. | 416/228 |
| 4,419,049 | 12/1983 | Gerboth et al. | 415/206 |
| 4,426,830 | 1/1984 | Tackett | 56/202 |
| 4,521,154 | 6/1985 | Corbett | 416/182 |
| 4,589,249 | 5/1986 | Walker et al. | 56/16.6 |
| 4,664,593 | 5/1987 | Hayashi et al. | 415/119 |
| 4,693,063 | 9/1987 | Hoepfner et al. | 56/16.6 |
| 4,703,614 | 11/1987 | Cooper et al. | 56/16.6 |
| 4,705,453 | 11/1987 | Hopfensperger | 415/119 |
| 4,711,073 | 12/1987 | Freier, Jr. et al. | 56/13.3 |
| 4,782,650 | 11/1988 | Walker | 56/16.6 |

FOREIGN PATENT DOCUMENTS

| | | | |
|---|---|---|---|
| 2227460 | 1/1974 | Fed. Rep. of Germany | 416/228 |
| 987194 | 1/1983 | U.S.S.R. | 416/186 R |
| 736835 | 9/1955 | United Kingdom | 416/228 |

*Primary Examiner*—Carl D. Price
*Assistant Examiner*—John T. Kwon
*Attorney, Agent, or Firm*—Hugh H. Drake

[57] ABSTRACT

A blower for fluidized particulates has a housing with an inlet in one wall. The housing defines a chamber which also has an outlet. A rotatably mounted shaft projects into the interior of the chamber. Circumferentially spaced around and projecting laterally from the shaft are a plurality of blades which individually have a shape selected to substantially maximize the impulsive pressure on the particles delivered through the outlet upon rotation of the shaft. Each of those blades has a notch defined toward the shaft from the laterally outer blade periphery with that notch having a size and shape selected to significantly reduce noise created by movement of the blade across the outlet. A plurality of paddles individually project outwardly from and are circumferentially spaced around the shaft adjacent to and circumferential aligned with respective ones of the notches, with that spacing of each paddle from the corresponding adjacent blade being selected to augment reduction of the noise while maintaining maximization of the pressure.

17 Claims, 2 Drawing Sheets

LOW NOISE IMPELLER

The present invention relates to blowers for fluidized particulates. More particularly, the invention pertains to an impeller structure that tends to maximize impulsive pressure upon the particulates while yet minimizing the level of noise created by the blower action.

Many forms of blowers find widespread use in moving air or other fluid for purposes including heating and cooling, in the moving of particulates such as grass clippings and in conveying materials in the nature of fine particles of sand, coal or other materials.

In designing most blowers, attention is given to the shape of the blades relative to flow rates and the different dimensions involved in order to maximize the flow rate for a given impeller speed and amount of energy used in driving the blower. An often unwanted result of blower operation is the development of audible noise. Besides noise emanating from the driving motor or engine and the rotation of moving parts, noise tends to be developed from the impact of the impeller blades on the fluid and any particulates carried thereby. Noise also is produced in association with the effect of the blades slicing across the moving fluid as well as across the inlet and outlet openings for the fluid.

The problem of blower noise has been addressed from at least 1907 in U.S. Pat. No. 869,868-Spencer. A more recent example will be found in U.S. Pat. No. 4,121,405-Wolf which has slots provided in a back plate. In another recent approach, the blades are S-shaped and also twisted relative to the central shaft while at the same time having a small cone formed on the trailing outer end of the blades.

A general object of the present invention is to provide a new and improved fluidized particulates blower in which pressure is maximized while at the same time there is a minimization of the development of noise.

A related object of the present invention is to accomplish the foregoing without reliance upon the provision of external acoustical shielding although that may be additionally included.

In accordance with the present invention, a fluidized particulates blower includes a housing having an inlet in one wall through which fluidized particulates are delivered into the front of a chamber defined in the housing and having an outlet in another wall through which the particulates are expelled from the chamber. Rotatably mounted and projecting into the chamber is a shaft. A plurality of blades are circumferentially spaced around and project laterally from the shaft into the chamber with those blades individually having a shape selected to substantially maximize the impulsive pressure on the delivered particles through the outlet upon rotation of the shaft. Each of the blades has a notch defined inwardly toward the shaft from the laterally outer blade periphery with that notch having a size and shape selected to significantly reduce noise created by movement of the blade across the outlet. Finally, a plurality of paddles individually project outwardly from and are circumferentially spaced around the shaft adjacent to and circumferentially aligned with respective ones of the notches with the spacing of each paddle from the adjacent blade being selected to augment reduction of the noise while maintaining maximization of the pressure.

The features of the present invention which are believed to be patentable are set forth with particularity in the appended claims. The organization and manner of operation of one specific embodiment of the invention, together with further objects and advantages thereof, may best be understood by reference to the following description taken in connection with the accompanying drawings, in the several figures of which like numerals identify like elements, and in which:

Figure 1:
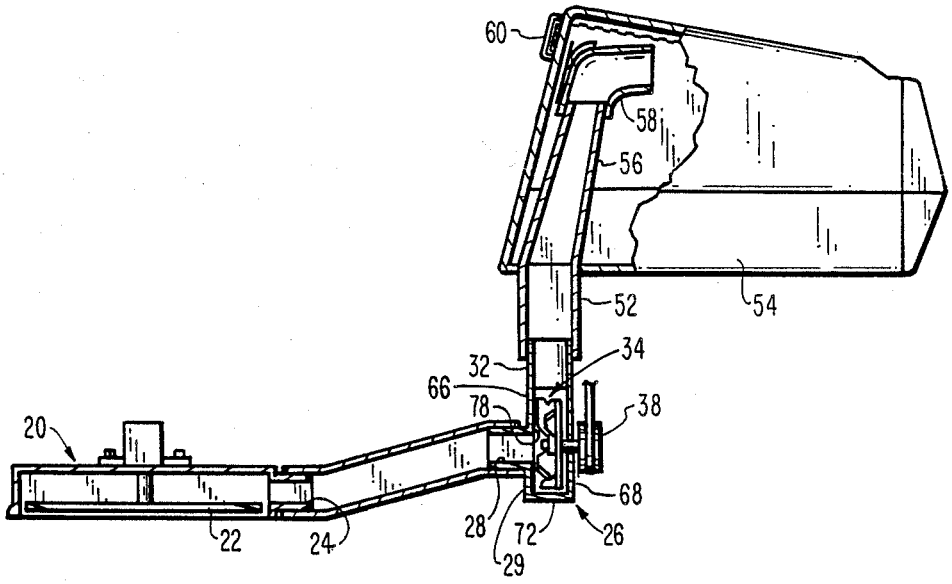
FIG. 1 is a fragmentary cross-sectional view of a blower system.

While the blower to be described in more detail may find use as incorporated into a wide variety of different systems and for the conveyance of any of an assortment of different particulates carried within and thus fluidized by a gaseous fluid such as air, the blower is specifically implemented in and discussed with respect to a self-propelled vehicular lawn mower. Accordingly, grass clippings are fluidized in a flowing stream of air being moved by the blower. Such a blower system is schematically illustrated in FIG. 1 which, except for the specific impeller shown, is taken from U.S. Pat. No. 4,782,650. To show the relationship between that illustrated in FIG. 1 and an entire mowing apparatus, that patent is incorporated herein by reference as is its predecessor U.S. Pat. No. 4,589,249 issued May 20, 1986 which contains additional description with respect to such overall mowing apparatus. However, further discussion of those patents is unnecessary to a full understanding of the blower to which the present application is directed.

In FIG. 1, a grass cutting assembly 20 includes a cutting blade 22 for clipping grass with those clippings tending to be thrown outwardly by centrifugal force. The clippings depart assembly 20 through a snout 24.

Figure 2:
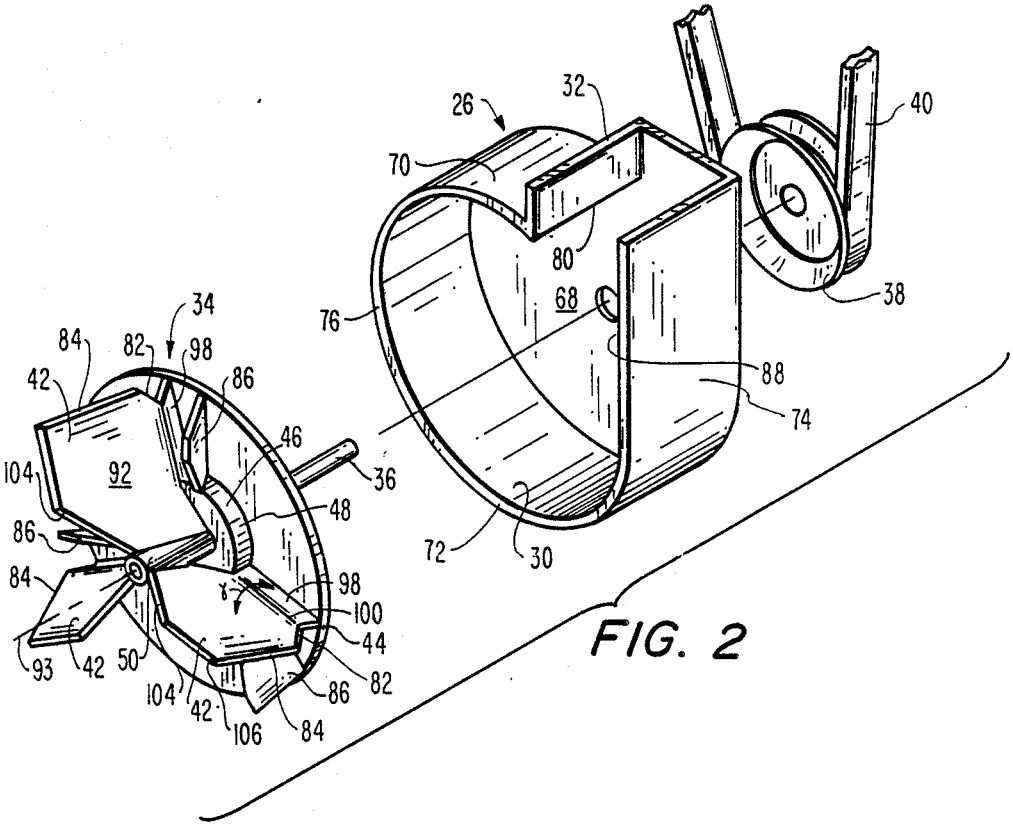
FIG. 2 is an exploded isometric partial view of a component shown in FIG. 1.
Figure 3:
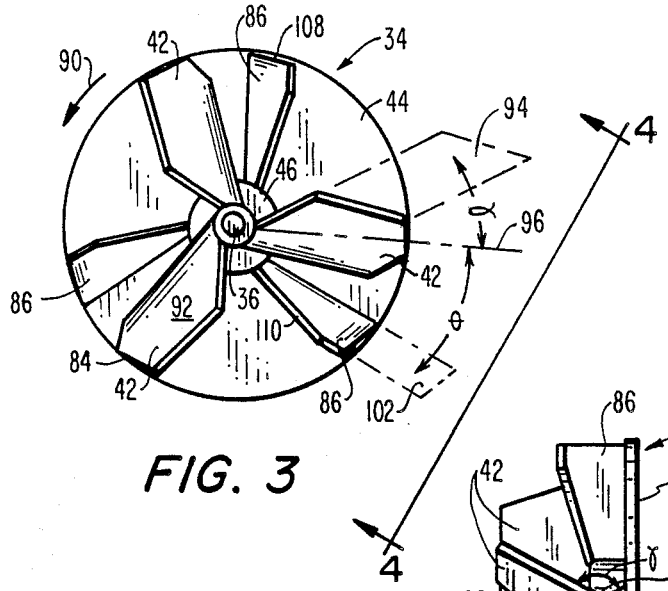
FIG. 3 is a front view of a subcomponent shown in FIGS. 1 and 2.
Figure 4:
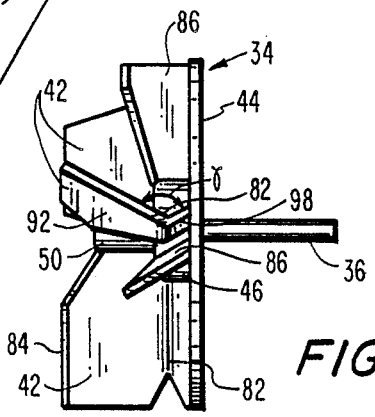
FIG. 4 is a side view of the subcomponent taken along a line 4—4 in FIG. 3.
Figure 5:
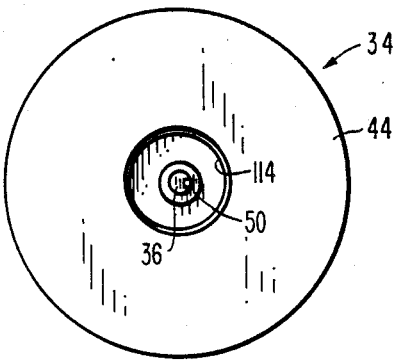
FIG. 5 is a rear view of the subcomponent shown in FIGS. 3 and 4.

Spaced behind assembly 20 is a blower assembly 26 from which projects an inlet snout 28. An initial conduit is coupled between snouts 24 and 28. Assembly 26 includes a housing 29 which defines an interior chamber 30 from a top wall of which upwardly projects an outlet snout 32. In FIG. 2, the front wall of housing 29 has been removed, although it can be viewed in FIG. 1. Disposed within housing 29 is an impeller 34 mounted on a rotatably mounted shaft 36 which, exteriorly to housing 29 carries a pulley 38 driven by a belt 40 from a source of motive power.

Mounted on and circumferentially spaced equally around shaft 36 are three impeller blades 42 fixed both to shaft 36 and also to a disc 44 mounted on a hub 46 affixed to shaft 36. Each impeller blade projects from disc 44 generally axially of shaft 36 and also projects generally laterally of shaft 36. Hub 46 has a rear portion 48 and a necked-down forward portion 50.

Outlet 32 has coupled upon its outer end another conduit 52 which leads into a clipping storage chamber or hopper 54. Conduit 52 continues upwardly as a conduit section 56 upon the upper end of which is mounted an elbow-shaped outlet nozzle 58. Nozzle 58 preferably is driven from a motor assembly at 60 coupled by a linkage to swing back and forth within the hopper and thereby evenly distribute the cuttings throughout the width of hopper 54.

In operation, the grass clippings may be given some initial propulsion into the initial conduit as a result of the rotation of blade 22. However, blower 26 then takes over and causes the fluidized stream of those cut-off particulates to be drawn through inlet snout 28 and impelled through outlet snout 32 on upwardly where they are then outletted from nozzle 58 into hopper 54. In a working version of the illustrated case of FIG. 1, shaft 36 rotates at 3400 RPM, chamber 30 has a spacing from its front wall to its rear wall adjacent to pulley 38 of about four and three-fourths inches, a spacing from its bottom wall to its top wall from which snout 32 projects of about nine and one-quarter inches, and disc 44 has a diameter of nine inches which also is the diameter of the movement path defined by the free peripheral end of each of impeller blades 42. Impeller 34 fits rather snugly within housing 29. Snout 32 is located at the end portion of the housing top wall which the moving impeller blades approach.

During the operation of such apparatus, there are several primary sources of acoustic noise within normal human hearing range. A first such source is the exhaust sound created by the internal combustion engine which supplies motive power not only to the vehicular apparatus but also to pulley 38 of the blower assembly. Engine manufacturers have made great strides in providing engines and exhaust systems with mufflers so as to create in themselves a reasonably tolerable level of noise power. The total noise, however, also includes that created by rotating cutting blades 22. In addition, there are minor amounts of further noise from the different bearings, linkages and fastenings present, in this example, in the overall vehicular mowing apparatus. Those latter noise sources can be lumped into a given amount of background noise which is present notwithstanding the additional contribution of noise created by the operation of blower 26. To determine total overall noise level including that contributed by operation of the blower, the noise probe of a conventional noise measurement instrument may be used to provide a series of readings at a variety of points spread over an imaginary sphere of a selected diameter and surrounding the apparatus. Those readings may then be averaged to yield an overall value which may be compared to a selected standard.

A former impeller had each blade projecting about one third its width in the axial direction of shaft 36 and then was angled to the shaft axis by about thirty degrees in the direction of blade movement during operation. With that earlier production impeller, the total noise level developed was one-hundred-ten decibels (addressed hereinafter as "dB") when measured by a standardized factory test. In that test, the noise probe was always located the same distance of about one foot horizontally spaced from housing 29. This factory test isolated the blower apparatus from what otherwise could be added background noise contributed by the overall vehicular machine. That same manner of noise measurement also was used to obtain all of the values to be discussed later for comparative purposes. As is well understood, the dB level is a relative measurement of the noise power level as compared to a condition of the absolutely zero noise power approached in acoustic testing chambers.

The significance of dB's in the present instance is that of comparing differences of noise level when changing from one condition to another. It becomes important to keep in mind that a difference of one dB represents ten times the common logarithm of the ratio of the difference in noise power levels. Consequently, a decrease of just three dB's in what may be measured as a noise level of over 100 dB still represents a reduction in noise power level by one-half. A decrease of six dB's represents a cutting of the noise power level to one-fourth that which it was.

Also measured in the case of that prior production blower impeller, as well as for each of the other alternatives discussed later, was the pressure of fluidized flow at the outlet end of snout 32 which was connected to a standardized outlet conduit. In that original case, the measured pressure was 0.65 inch of water as measured at an altitude of about 5000 feet above sea level. For adequately conveying the clippings through the initial conduit and on into the body of hopper 54, that pressure was quite adequate for the purpose at hand. However, the noise power level of one-hundred and ten was deemed to be excessive at least for some purposes. When reference is made hereinafter to so much of an inch of pressure, the meaning is inches of water obtained as just described.

FIGS. 2–5 shown in more detail the specific embodiment of an improved blower and impeller therefor. Included in housing 29 is an inlet front wall 66, a rear wall 68, a top wall 70, a bottom wall 72, one opposing side wall 74 and another opposing side wall 76 all of which together define interior chamber 30. An inlet 78 is defined in front wall 66 from which projects coupling snout 28. An outlet 80 is defined in top wall 70 at one side thereof, being located adjacent to side wall 74. Coupling snout 32 projects upwardly from outlet 80.

Rotatably mounted shaft 36 projects through rear wall 68 into chamber 30. The plurality of blades 42 are circumferentially spaced around and project laterally from shaft 36 within chamber 30. Each of blades 42 individually has a shape selected to substantially maximize the impulsive pressure on the delivered particulates, in this case in the form of grass clippings, through outlet 80 upon rotation of shaft 36. Each of blades 42 has a notch 82 defined inwardly toward shaft 36 from the laterally outer blade periphery 84 with notch 82 having a size and shape selected to significantly reduce noise created by movement of a corresponding blade across the outlet.

A plurality of paddles 86 individually project outwardly from and are circumferentially spaced around shaft 36 in a position adjacent to and circumferentially aligned with respective ones of notches 82. The spacing of each paddle 86 from the corresponding adjacent blade 42 is selected to augment reduction of the noise while maintaining maximization of the pressure.

In this instance, disc 44 is secured transversely to shaft 36 within chamber 30 and is spaced from inlet 78 in a position beyond but alongside outlet 80 with the adjacent rear sides of blades 42 being secured to disc 44 substantially radially of shaft 36. Disc 44 is spaced but a minimal distance from rear wall 68. The joinder of each paddle 86 to disc 44 also is substantially radial of shaft 36.

In principle, disc 44 might not be needed, with the rear peripheral sides of blades 42 themselves being located closely adjacent to rear wall 68. However, the inclusion of disc 44 is preferred in order to significantly increase the rigidity and mounting strength of blades 42 and paddles 86 which are both secured to disc 44. In addition, the inclusion of disc 44 assists in preventing a buildup of clippings on rear wall 68, especially when those clippings may be somewhat moist.

It will be noted that inlet 78 is located generally coaxially with shaft 36. Outlet 80 is located adjacent to the path of movement of the laterally outer peripheries 84 of blades 42. Moreover, the trailing boundary 88 of outlet 80, relative to that movement in the direction 90 of the laterally outer blade peripheries, is disposed to lie in a direction parallel to the axis of shaft 36. In a given implementation, however, the inlet and outlet sizes and positions as well as the orientation and shape of the trailing boundary all are parameters which may be fine-tuned in seeking optimum performance in respects of pressure and noise power level.

Figure 6:
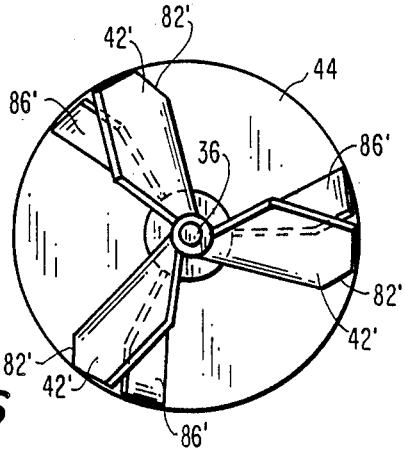
FIG. 6 is a front view of an alternative to the subcomponent of FIGS. 2–5.

As specifically shown in FIGS. 2–5, each of paddles 86 is spaced, in the direction 90 of movement of blades 42, behind the corresponding adjacent blade. That is the preferred arrangement. One alternative which still allows significant improvement is to locate each of paddles 86' in the direction 90 of blade movement ahead of the corresponding blade 42'. That alternative is depicted in FIG. 6 showing of the twisting or slanting of blades 42' and placing paddles 86' in front of blades 42' yielded a noise level of one-hundred-three dB with a pressure of 0.67 inch. In either case, it will be noted that the width of paddles 86 or 86' in the axial direction of shaft 36 is substantially greater than the width of notches 82. Notches 82 are V-shaped as shown, but their exact shape may be modified pursuant to empirical testing.

In further detail with respect to the specific embodiment, each of blades 42 has a primary portion 92 of flat-shape which is twisted relative to the axis 93 of shaft 36 as to lie in a blade plane 94 in which portion 92 lies and which plane 94 forms an angle $\alpha$ to a shaft 96 plane (seen edgewise in FIG. 3) in which lies axis 93 of shaft 36 and which intersects blade plane 94 to define a line disposed generally radially of shaft. Each of blades 42 further includes a secondary portion 98 projecting laterally from shaft 36 along and joined to the rear peripheral margin of primary portion 92 as to define an angle $\alpha$ therewith. Notch 82 is formed into both of primary and secondary portions with the apex of the notch being along the line 100 of their mutual joinder.

Each of paddles 86 is primarily of a flat shape and is twisted or slanted relative to axis 93 of shaft 36 as to lie in a paddle plane 102 which forms an angle $\theta$ to shaft plane 96 in which lies axis 93 of shaft 36 and which intersects paddle plane 102 to define a line (plane edge 96) generally radially of shaft 36. As best shown in FIG. 2, the lower portion 104 of the frontal peripheral margin 106 of each of blades 42 is shaped to slant rearwardly in the direction toward shaft 36. In one additional version, angled lower front margin 104 was included on each blade and a small rectangular notch was included at the disc end of the outer peripheral blade margin. That significantly improved noise performance down to one-hundred-two dB but at the cost of a pressure reduction down to 0.57 inch.

In the specific embodiments illustrated, the overall blower dimensions as to the housing and the depth of blade coverage is the same as previously discussed. Each notch 82 begins at disc 44 and has a peripheral width of about three-quarters of an inch and a depth of about the same. Each paddle 86 has a width of about two inches at its outer periphery 108 and has a front margin 110 that slants inwardly toward shaft 36 after a radial distance of about three-fourths inch. Each paddle 86 slants rearwardly to disc 44 at angle $\theta$ of approximately thirty degrees to a normal to the disc, as does each secondary portion 98 of blades 42. Each primary portion 92 of blades 42 slants in the forward direction 90 of rotation at angle $\alpha$ of approximately thirty degrees with respect to a normal to disc 44.

A hub 46 is affixed securely on shaft 36 and each of blades 42 are in turn secured to hub 46 and its neck. Paddles 86 are secured to larger portion 48 of hub 46. On the side of disc 44 opposite blades 42 and paddles 86, hub 46 defines a recess 114 into just the bottom of which neck 50 protrudes. Recess 114 has been found to decrease the tendency of grass clippings to collect and build up around shaft 36 at its point of entry into chamber 30.

Within any given environment, the pressure to be developed will, of course, basically determine the size of the blower and the necessary speed of impeller rotation. That established, the specific dimensioning of notches 82 and paddles 86 and the optimum spacing of each paddle from its associated blade 42 is best determined empirically by way of testing several prototypes with minor variations one way or another.

For the particular embodiment as first described above in detail, the result as compared with the prior approach first discussed was to develop an outlet pressure of 0.70 inch at a noise level of one-hundred-two dB. That will be seen to represent a worthwhile increase in pressure while at the same time lowering the noise power level to well less than one-fourth that which it had been.

A slight reduction in the distance of each paddle behind its associated blade was found to very slightly increase pressure at the expense of one dB. Adjustment of the spacing of the paddle from the blade to be slightly greater than that specifically described herein maintained about the same pressure but resulted in an increase in noise power level of two dB over the optimum. When notches 82 were taped closed in the embodiment above first described in detail, the pressure stayed about the same but the noise level substantially increased to about one-hundred-eight dB.

Many other tests were conducted of different blade shapes. Those were all unsuccessful in terms of pressure and/or noise power level. This included increasing the number of blades from those shown, creating a gap between each blade and the hub, adding a tail cone to the outer end of each blade, and constructing the blades to have an S-shape with or without twist therein. However, one improvement in the blade alone which by itself contributed to noise reduction down to about one-hundred-four dB and still allowed a pressure of 0.67 inch involved forming the blade to have a frontal lower margin which was shaped to slant rearwardly in the direction toward the shaft at an angle of about thirty degrees relative to the shaft axis. In that particular version, each blade had what would amount to half of the illustrated notch and that was formed in the peripheral outer blade margin adjacent to disc 44.

It will thus be seen that there are several different new features which in the totality enable maximum performance. In a given case, certain of those features may be eliminated while still obtaining a useful degree of improved performance in respect of pressure and/or noise level. At the same time, the different versions tested, as also discussed for comparison purposes, suggest directions in which one might not wish to go.

While particular embodiments of the invention have been shown and described, and various alternatives and modifications have been taught, it will be obvious to those skilled in the art that changes and modifications may be made without departing from the invention in its broader aspects and in view of the invention as a whole. Therefore, the aim in the appended claims is to cover all such changes and modifications as fall within the true spirit and scope of that which is patentable.

I claim:

1. A fluidized particulates blower comprising:
a housing having an inlet in one wall through which fluidized particulates are delivered into the front of a chamber defined by said housing and having an outlet in another wall through which said particulates are impelled from said chamber;
a rotatably mounted shaft projecting into the interior of said chamber;
a plurality of blades circumferentially spaced around and projecting laterally from said shaft within said chamber with said blades having a shape selected to substantially maximize the impulsive pressure on the delivered particulates through said outlet upon rotation of said shaft;
each of said blades having a notch defined inwardly toward said shaft from the laterally outer blade periphery with said notch having a size and shape selected to significantly reduce noise created by movement of said blade across said outlet;
and a plurality of paddles individually projecting outwardly from and circumferentially spaced around said shaft adjacent to and circumferentially aligned with respective ones of said notches with the spacing of each paddle from the corresponding adjacent blade being selected to augment reduction of said noise while maintaining maximization of said pressure.

2. A blower as defined in claim 1 which includes a disc secured transversely to said shaft within said chamber and spaced from said inlet in a position beyond but alongside said outlet with the adjacent sides of said blades being secured to said disc.

3. A blower as defined in claim 2 in which a recess is defined into said disc from its side opposite said blades and paddles.

4. A blower as defined in claim 1 in which said inlet is located generally coaxially with said shaft.

5. A blower as defined in claim 1 in which said outlet is located adjacent to the path of movement of the laterally outer blade peripheries.

6. A blower as defined in claim 5 in which the trailing boundary of said outlet, relative to said movement, is disposed to lie in a direction parallel to the axis of said shaft.

7. A blower as defined in claim 1 in which each of said paddles is spaced in the direction of blade movement ahead of the corresponding adjacent blade.

8. A blower as defined in claim 1 in which each of said paddles is spaced in the direction of blade movement behind the corresponding adjacent blade.

9. A blower as defined in claims 7 or 8 in which the width of said paddles in the axial direction of said shaft is substantially greater than the width of said notches.

10. A blower as defined in claim 1 in which each of said blades has a primary portion of flat shape and is slanted relative to the axis of said shaft as to lie in a blade plane which forms an angle to a shaft plane in which lies the axis of said shaft and which intersects said blade plane to define a line disposed generally radially of said shaft.

11. A blower as defined in claim 10 in which each of said blades further includes a secondary portion projecting laterally from said shaft along and joined to one lateral peripheral margin of said primary portion as to define an angle therewith.

12. A blower as defined in claim 11 in which said notch is formed into both of said primary and secondary portions.

13. A blower as defined in claim 1 in which each of said paddles spans a distance generally in the direction axially of said shaft that is substantially greater than the width of said notch.

14. A blower as defined in claim 1 in which each of said paddles is primarily of flat shape and is slanted relative to the axis of said shaft as to lie in a paddle plane which forms an angle to a shaft plane in which lies the axis of said shaft and which intersects said paddle plane to define a line generally radially of said shaft.

15. A blower as defined in claim 1 wherein the lower portion of the frontal peripheral margin of each of said blades is shaped to slant rearwardly in the direction toward said shaft.

16. A fluidized particulates blower comprising:
a housing having an inlet in one wall through which fluidized particulates are delivered into the front of a chamber defined by said housing and having an outlet in another wall through which said particulates are impelled from said chamber;
a rotatably mounted shaft projecting into the interior of said chamber with said inlet being located generally coaxially with said shaft;
a plurality of blades circumferentially spaced around and projecting laterally from said shaft within said chamber with said blades having a shape selected to substantially maximize the impulsive pressure on the delivered particulates through said outlet upon rotation of said shaft, said outlet being located adjacent to the path of movement of the laterally outer blade peripheries;
each of said blades having a notch defined inwardly toward said shaft from the laterally outer blade periphery with said notch having a size and shape selected to significantly reduce noise created by movement of said blade across said outlet;
a plurality of paddles individually projecting outwardly from and circumferentially spaced around said shaft adjacent to and circumferentially aligned with respective ones of said notches with the spacing of each paddle from the corresponding adjacent blade being selected to augment reduction of said noise while maintaining maximization of said pressure;
and a disc secured transversely to said shaft within said chamber and spaced from said inlet in a position beyond but alongside said outlet with the adjacent sides of said blades being secured to said disc.

17. A blower as defined in claim 16 in which each of said blades has a primary portion of flat shape and is slanted relative to the axis of said shaft as to lie in a blade plane which forms an angle to a shaft plane in which lies the axis of said shaft and which intersects said blade plane to define a line disposed generally radially of said shaft and in which each of said blades further includes a secondary portion projecting laterally from said shaft along and joined to one lateral peripheral margin of said primary portion as to define an angle therewith.

* * * * *

UNITED STATES PATENT AND TRADEMARK OFFICE

CERTIFICATE OF CORRECTION

PATENT NO. : 4,930,981

DATED : June 5, 1990

INVENTOR(S) : Dean M. Walker

It is certified that error appears in the above-identified patent and that said Letters Patent is hereby corrected as shown below:

Column 4, line 25: "shown" should read -- show --.

Column 5, lines 23 and 24: "FIG. 6 showing of the twisting or slanting of blades 42' and placing" should read -- FIG 6. Placing --.

Column 5, line 36: "shaft 96 plane" should read -- shaft plane 96 --.

Column 5, line 43: "$\alpha$" should read -- $\gamma$ --.

Signed and Sealed this

Thirteenth Day of August, 1991

*Attest:*

*Attesting Officer*

HARRY F. MANBECK, JR.

*Commissioner of Patents and Trademarks*